US005116041A

United States Patent [19]

Pollich

[11] Patent Number: 5,116,041

[45] Date of Patent: May 26, 1992

[54] SHEET FEEDER HAVING AN AUXILIARY PIPE FOR NON-STOP OPERATION

[75] Inventor: Gerhard Pollich, Heidelberg, Fed. Rep. of Germany

[73] Assignee: Heidelberger Druckmaschinen AG, Heidelberg, Fed. Rep. of Germany

[21] Appl. No.: 633,100

[22] Filed: Dec. 20, 1990

[30] Foreign Application Priority Data

Dec. 20, 1989 [DE] Fed. Rep. of Germany ..... 3941993

[51] Int. Cl.[5] ..... B65H 1/30

[52] U.S. Cl. ..... 271/158; 271/30.1; 414/795.8; 414/796.7

[58] Field of Search ..... 271/158, 159, 157, 301.1, 271/11, 12; 414/795.8, 796.7, 797, 790.1, 790, 790.8

[56] References Cited

U.S. PATENT DOCUMENTS 2,968,481 1/1961 Taylor ..... 271/159
3,006,635 10/1961 Elliott et al. ..... 271/159 X
3,975,011 8/1976 Marass .

FOREIGN PATENT DOCUMENTS 1003262 8/1965 United Kingdom .
1004674 8/1965 United Kingdom .

*Primary Examiner*—David H. Bollinger
*Attorney, Agent, or Firm*—Herbert L. Lerner; Laurence A. Greenberg

[57] ABSTRACT

A sheet feeder having an auxiliary pile supporting device for non-stop operation includes a removable auxiliary pile support of given thickness on which an auxiliary pile of sheets are supported above a liftable main sheet pile with which it is joinable. The sheet feeder bar stops disposed in a sheet feeding path of the auxiliary sheet pile and engageable by a leading region of the auxiliary sheet pile as viewed in sheet feeding direction. The sheet feeder further includes a holding device disposed substantially in a plane extending over the width of the sheets and movable under the leading region of the auxiliary pile, when the auxiliary pile support is removed, for permitting leading edges of the sheets in the auxiliary pile to be lowered a distance equal to less than the thickness of the removed auxiliary pile.

8 Claims, 4 Drawing Sheets

SHEET FEEDER HAVING AN AUXILIARY PIPE FOR NON-STOP OPERATION

The invention relates to a sheet feeder having an auxiliary pile for non-stop operation.

Sheet feeders with auxiliary piles and devices for compensating for a lowering of the auxiliary pile which occurs during a pile change have become known heretofore from German Patent 25 05 530. This known construction is provided with switches, a first switch thereof serving to cause a lifting of the pile and a suction head while the support for the auxiliary pile is being withdrawn, and a second switch thereof enabling the suction head to be returned to its original position after the support for the auxiliary pile has been withdrawn completely. A disadvantage in this regard is the great technical outlay for the suction-head control system.

A further disadvantage of this heretofore known construction is that, by withdrawing the auxiliary pile support, whether in the form of supporting rods or a supporting rake, a lowering of the forward or leading edge of the auxiliary sheet pile always occurs. This applies especially to thin printing materials. Before the pile and the suction head control system react, the auxiliary pile support must have been drawn out to at least the first switch.

Yet another disadvantage of the aforementioned known type of construction is that the control system does not function with adequate precision for paper sheets which have a longitudinal wave formed therein, for very thick printing material, such as cardboard, for example, or for the case wherein the height of the residual sheet pile is a factor.

One can hardly assume that stiff cardboard sheets or longitudinally wavy paper sheets will immediately follow the inclined contour of the auxiliary pile support when the latter is being withdrawn. Although thin printing material may indeed follow the support as it is being withdrawn, with very thick or stiffened printing materials, however, a delay due to the greater stiffness of the sheets occurs in the lowering of the front or leading edge of the sheet pile when the auxiliary pile support is being withdrawn. A result thereof is that a lifting of the pile and an adjustment of the suction head takes place even though the cardboard sheets or the longitudinally waved paper sheets have not yet been lowered at the forward or leading edge thereof. This means that the trip or release switches must be adjusted to or matched with the respective type of paper which is used. Moreover, it means that the pressman has to decide when to initiate the sheet pile follow-up control. Automatic follow-up control is thus rendered useless.

This heretofore known construction provides an expensive and complex adjustment of the suction head to the surface of the sheet pile, however, it does not satisfactorily solve the problem of the lowering of the leading or forward edge of the sheet pile.

A further disadvantage of this heretofore known construction is that the arrangement of switches therein considerably increases the overall structural length of the sheet feeder. This calls for an additional space requirement when installing a printing machine.

It is accordingly an object of the invention to provide a sheet feeder having an auxiliary pile for non-stop operation which avoids the foregoing disadvantages of the heretofore known state of the art.

It is a more specific object of the invention to provide such a sheet feeder wherein a joining of a main sheet pile and an auxiliary sheet pile is optimized and a transfer of the auxiliary sheet pile to the main sheet pile when the auxiliary pile support is withdrawn is improved.

With the foregoing and other objects in view there is provided in accordance with the invention a sheet feeder having an auxiliary pile supporting device for non-stop operation including a removable auxiliary pile support of given thickness on which an auxiliary pile of sheets is supported above a liftable main sheet pile with which it is joinable, and having stops disposed in a sheet feeding path of the auxiliary sheet pile and engageable by a leading region thereof as viewed in sheet feeding direction, comprising holding means disposed substantially in a plane extending over the width of the sheets and movable under the leading region of the auxiliary pile, when the auxiliary pile support is removed, for permitting leading edges of the sheets in the auxiliary piles to be lowered a distance equal to less than the thickness of the removed auxiliary pile.

An advantage deriving from the construction of this embodiment according to the invention is that a continuous sheet supply is assured when joining or combining the auxiliary and the main piles. The introduction of the holding means under the front or leading edge of the pile ensures a reliable transport or conveyance of the gripped sheets over the front stops. By supporting the front or leading edges of the sheets in the pile, a follow-up of the auxiliary pile is not required in order to compensate for the lowering of the front or leading edge. For this reason, there is no impairment of the sheet sucking process performed by the lifting and the transporting suckers in the rear region of the auxiliary pile. This embodiment of the invention considerably increases the operational reliability and thus permits higher machine speeds for stream-feeding shingled or overlapping sheets which are to be printed. Furthermore, the machine speed can be maintained when the two piles are being joined or combined, and it is no longer necessary to reduce the machine speed.

In accordance with another feature of the invention, the holding means are a plurality of take-up fingers disposed at mutually spaced locations adjacent one another and distributed over the width of the sheets.

In accordance with a further feature of the invention, the take-up fingers are formed as substantially flat members having a tapered or sloping front end region, and further included are displaceable guide members wherein the substantially flat members are mounted, and means for displacing the guide members transversely to the sheet feeding direction.

In accordance with an added feature of the invention, the displacing means comprise a pneumatic or hydraulic drive cylinder directly connected to the guide members.

In accordance with an alternative feature of the invention, the displacing means comprise a drive cylinder and respective levers connecting the drive cylinder to the guide members.

The advantage of these features of the invention are that due to the taper or slope of the front region of the substantially flat members, the sheet edges are not bent when the substantially flat members are introduced under the auxiliary pile. The displaceable guide members permit displacement and adjustment of the holding means to any desired sheet size or format. The holding means can be actuated pneumatically or hydraulically via actuating levers and other levers or directly by means of a drive cylinder.

In accordance with still another feature of the invention, the auxiliary pile support is formed with inclined ends, and the guide members are disposed directly adjacent the inclined ends.

An advantage of this feature of the invention is that the holding means are driven under the auxiliary pile in the regions between each two bars or rods, for example, the sheets in those regions, sagging due to their own weight. Thus, it is possible to maintain exactly the front or leading edge of the pile when the auxiliary pile support is being removed.

In accordance with still a further feature of the invention, there are provided means for individually actuating the take-up fingers.

In accordance with still an added feature of the invention, the actuating means comprise respective levers connected to the take-up fingers.

The capability of processing even extraordinary sheet sizes or formats thus represents an advantage of this specific feature.

In accordance with a concomitant feature of the invention, there are provided means for automatically driving the holding means under the auxiliary pile when the main pile is lowered or converted from main pile operation to auxiliary pile operation, and for automatically withdrawing the holding means therefrom after the main and auxiliary piles have been joined.

This provides the advantage that operating errors or a delayed introduction of the holding means by the pressman or other personnel, does not negatively affect or interrupt the sheet feeding process.

Other features which are considered as characteristic for the invention are set forth in the appended claims.

Although the invention is illustrated and described herein as embodied in a sheet feeder having an auxiliary pile for non-stop operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
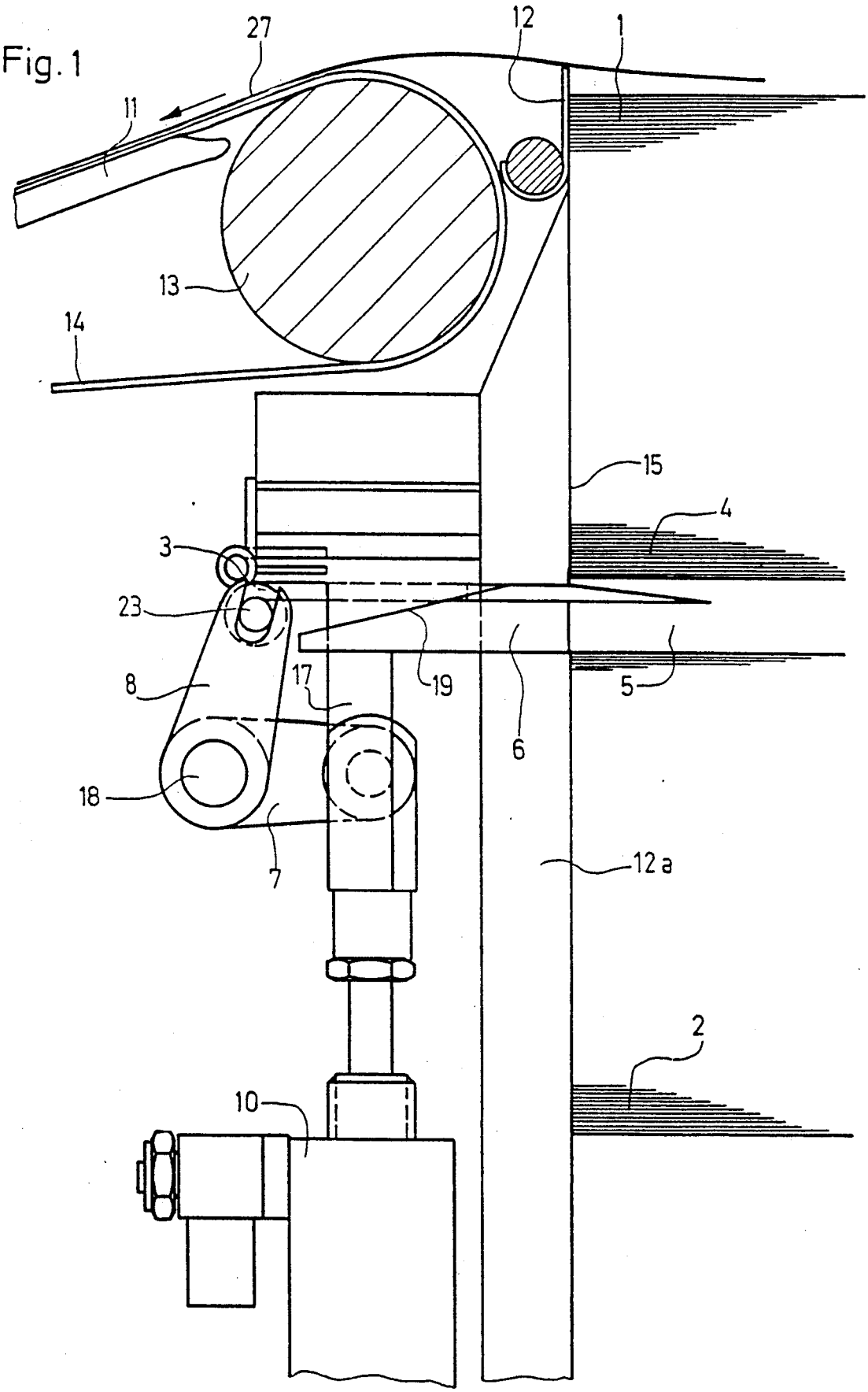
FIG. 1 is a fragmentary side elevational view of a sheet feeder having an auxiliary pile for non-stop operation, in accordance with the invention and, more specifically, showing a front or forward part of the sheet feeder.
Figure 4:
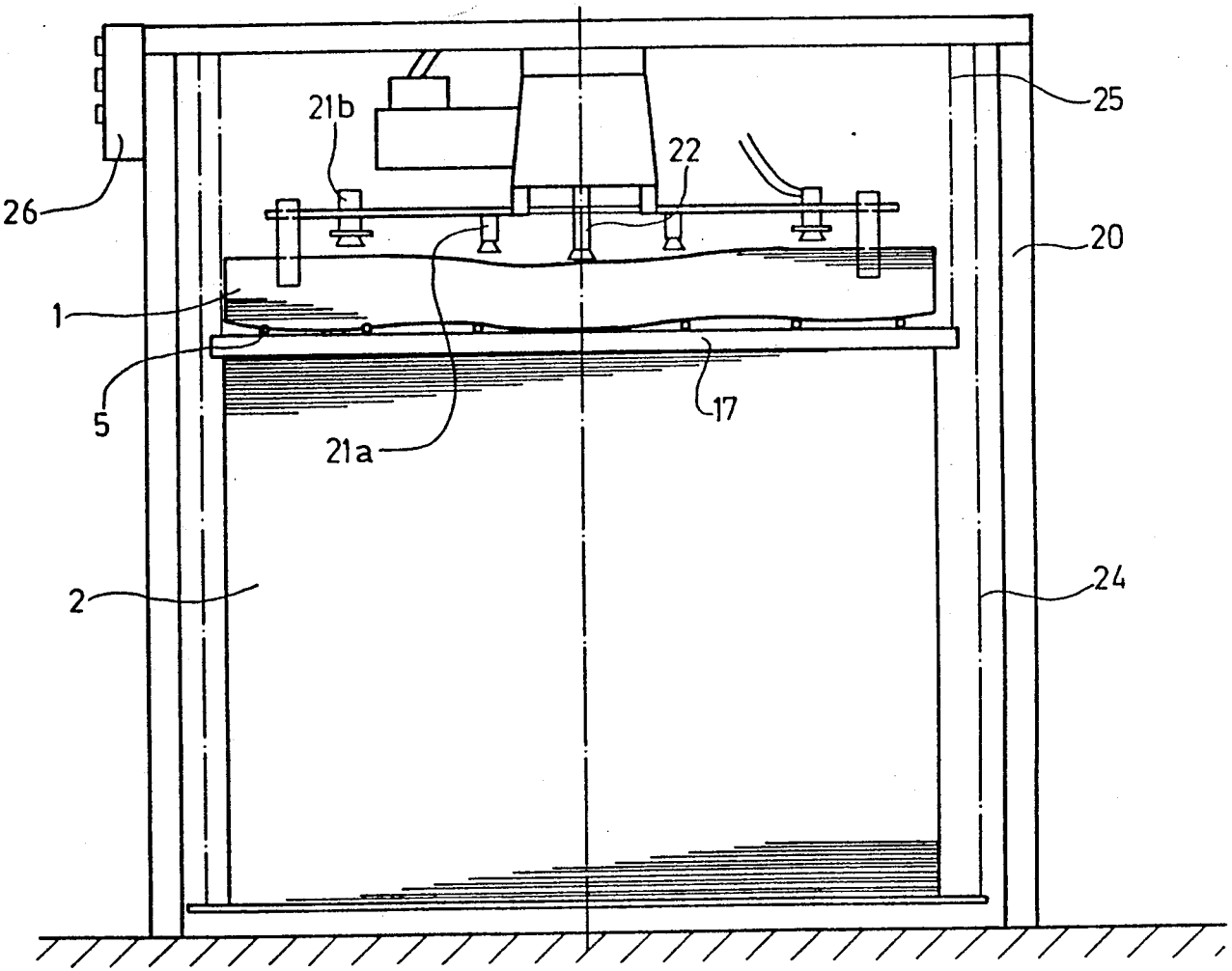
FIG. 4 is an diagrammatic front elevational view of a sheet feeder with main and auxiliary sheet piles.

Referring now to the drawing and, first, particularly to FIG. 1 thereof, there is shown therein a sheet feeder of a sheet-fed printing machine having an auxiliary sheet pile 1 and a main sheet pile 2 (also note FIG. 4), both of which are joined or combined by withdrawing a support 5 for the auxiliary sheet pile. The auxiliary pile support 5 is formed, for example, of a supporting rake or of several supporting rods or bars which are distributed over the width of the sheet pile so as to support it. Operating switches 26 as well as moving devices for a lifting chain 24 for the main pile 2 and for an auxiliary chain 25 for the auxiliary pile 1 are mounted on a frame 20 of the sheet feeder.

The instant the auxiliary pile 1 takes over the paper feed at the sheet feeder, take-up fingers 3 which are mounted in guide members 6 are driven under the front or forward region 4 of the auxiliary pile 1 in order to prevent a lowering of the leading or forward edge 15 of the auxiliary pile 1 when the auxiliary pile support 5 is removed. Because the paper feed is then taken over by the auxiliary pile 1, a new main pile 2 can be made ready.

A desirable arrangement of the guide members 6 and the take-up fingers 3 along the forward or leading edge of the sheets calls for the take-up fingers 3 to be driven under the leading or forward edge 15 of the auxiliary pile 1 near the supporting rods or bars or the teeth of the supporting rake. Because the sheets lying in the residual pile sag due to their own weight in regions between each pair of supporting bars or rods or between mutually adjacent teeth of the supporting rake, the take-up fingers are introduced near the supporting rods or bars or the teeth of the supporting rake forming the auxiliary pile support 5.

By supporting the forward or leading edge 15 of the auxiliary pile 1 with the take-up fingers 3, assurance is provided that the paper sheets 27 will be gripped by lifting suckers 21*a* and transport suckers 21*b* (FIG. 4) and can be conveyed over tiltable front stops 12 without catching thereon. The forward or leading edge 15 of the auxiliary pile 1 is considerably more sensitive to a lowering of the pile 1 due to a removal of the auxiliary pile support 5 than is the rear or trailing edge 16 of the auxiliary pile 1, because changes in the spacing between the lift suckers 21*a* and the transport suckers 21*b* as well as the uppermost sheet of the auxiliary pile 1 can be compensated for more readily at the rear or trailing edge 16. The paper sheets 27 are conveyed by conveyor belts 14 driven by belt rollers 13 from the auxiliary pile 1 to the feed board or table 11 in a shingled or fish-scale overlapping arrangement.

After a change-over from auxiliary pile operation to main pile operation, the main pile 2 is moved to a position just beneath the auxiliary pile 1. Both piles 1 and 2 are then lifted in synchronism by the lifting chain 24 and the auxiliary chain 25, respectively.

The instant the auxiliary pile 1 has reached a residual pile height of a few centimeters, the auxiliary pile support 5, such as the support rods or bars, of the auxiliary pile 1 are withdrawn starting from the middle of the auxiliary pile 1. This causes a lowering of the rear edge 16 of the auxiliary pile 1 in the middle of the pile, and due to a slope or inclination 19 of the auxiliary pile support 5, a gradual transition is assured. Thus, an approximately constant spacing between the uppermost sheet of the auxiliary pile 1 and the lifting suckers 21*a* and the transport suckers 21*b* is maintained.

After the auxiliary pile support 5 has been completely removed and after the auxiliary pile 1 has reached a residual pile height, the take-up fingers 3 are withdrawn from or driven out of the front or forward auxiliary pile region 4. This is effected by a switch 28 which interrogates the residual pile height of the auxiliary pile 1. Due to the sloping or inclined front or forward region of the take-up fingers 3, the front or forward edge 15 of the auxiliary pile 1 is gradually lowered onto the uppermost sheet of the main pile 2 and the two piles 1 and 2 are thus joined or combined into one pile.

Figure 2:
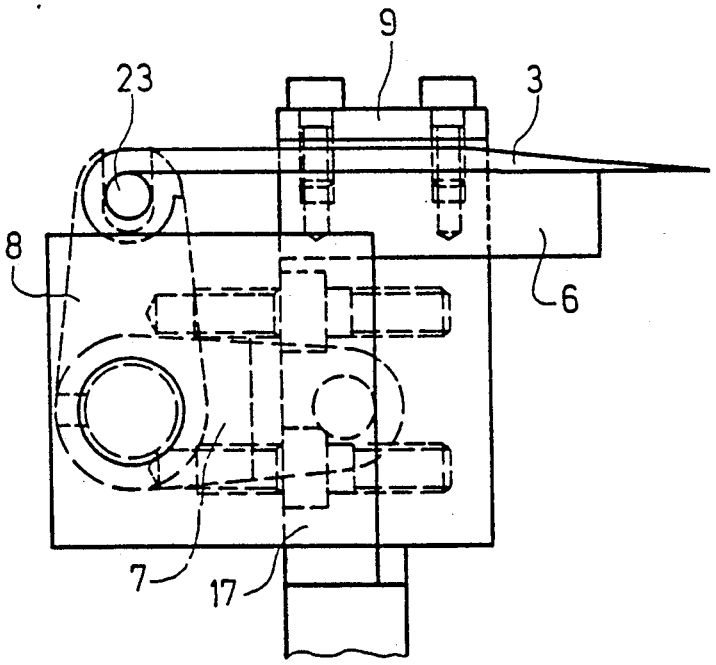
FIG. 2 is a fragmentary view of FIG. 1 showing a take-up finger with a deflecting device forming part of the invention.

The guide members 6 for the take-up fingers 3 can be displaced on a support rail 17 along the front edge 15 of the auxiliary pile 1 transversely to the sheet-feeding direction, and can be adjusted or matched to different sheet sizes or formats. The guide members 6 are provided with a cover plate 9 (FIG. 2) for guiding the take-up fingers 3. FIG. 2 illustrates an almost complete embodiment thereof. The take-up fingers 3 are moved through the intermediary of a bolt 23 and an actuating or drive lever 7 which, in turn, is connected to a drive cylinder 10 (note FIG. 1) via a lever 8. Air or a liquid may serve as a working medium in the drive cylinder 10.

Figure 3:
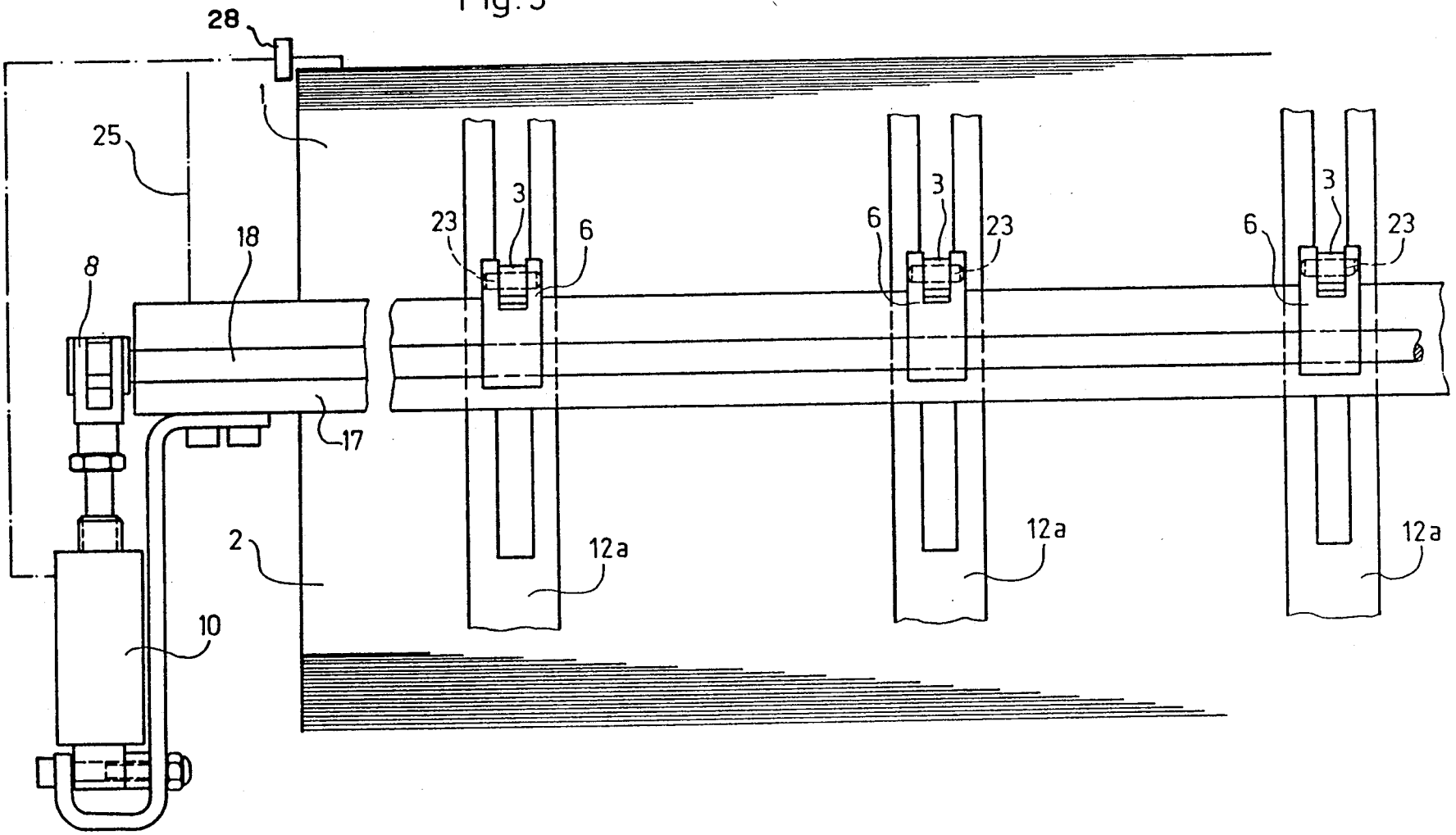
FIG. 3 is a front elevational view of FIG. 1, slightly reduced in size, showing the sheet feeder with mutually adjacent take-up fingers.

The drive cylinder 10 can act upon one take-up finger 3, respectively, via the drive lever 7 and the lever 8 in order to permit a separate movement thereof. On the other hand, the drive cylinder 10 can also move a shaft 18, however, which, in turn, moves several take-up fingers 3 (note FIG. 3) via the drive lever 7 and the lever 8. Thus, the drive cylinder 10 can actuate several take-up fingers 3 simultaneously.

By chamfering or beveling the take-up fingers 3 at a front region thereof, damage to the front or forward edge of the auxiliary pile 1 is prevented when the take-up fingers 3 are introduced or driven under the auxiliary pile 1.

The foregoing is a description corresponding in substance to German Application P 39 41 993.2, dated Dec. 20, 1989, the International priority of which is being claimed for the instant application, and which is hereby made part of this application. Any material discrepancies between the foregoing specification and the aforementioned corresponding German application are to be resolved in favor of the latter.

I claim:

1. Sheet feeder having an auxiliary pile supporting device for non-stop operation including an auxiliary pile support of given thickness removable from one location at which an auxiliary pile of sheets is supported thereon above a liftable main sheet pile to another location at which no auxiliary pile sheets are supported thereon, and the sheet feeder also having stops disposed in a sheet feeding path of the auxiliary sheet pile and engageable by a leading region of the auxiliary sheet pile as viewed in sheet feeding direction, the sheet feeder further comprising holding means disposed substantially in a plane extending over the width of the sheets and movable under the leading region of the auxiliary pile, when the auxiliary pile support has been removed from the one location, for permitting leading edges of the sheets in the auxiliary pile to be lowered a distance equal to less than the thickness of the removed auxiliary pile so that the auxiliary pile joins the main pile, and displacing means comprising a pneumatic or hydraulic drive cylinder connected to said holding means for moving said holding means under the leading region of the auxiliary pile.

2. Sheet feeder according to claim 1, wherein said holding means are a plurality of take-up fingers disposed at mutually spaced locations adjacent one another and distributed over the width of the sheets.

3. Sheet feeder according to claim 2, wherein said take-up fingers are formed as substantially flat members having a tapered or sloping front end region, and including displaceable guide members wherein said substantially flat members are mounted, and means comprising a support rail whereon said guide members are displaceable transversely to the sheet feeding direction.

4. Sheet feeder according to claim 3, wherein the auxiliary pile support is formed with inclined ends, and said guide members are disposed directly adjacent said inclined ends.

5. Sheet feeder according to claim 2, wherein said displacing means further comprise respective levers connecting said drive cylinder to said take-up fingers for moving said take-up fingers.

6. Sheet feeder having an auxiliary pile supporting device for non-stop operation including an auxiliary pile support of given thickness removable from one location at which an auxiliary pile of sheets is supported thereon above a liftable main sheet pile to another location at which no auxiliary pile sheets are supported thereon, and the sheet feeder also having stops disposed in a sheet feeding path of the auxiliary sheet pile and engageable by a leading region of the auxiliary sheet pile as viewed in sheet feeding direction, the sheet feeder further comprising holding means disposed substantially in a plane extending over the width of the sheets and movable under the leading region of the auxiliary pile, when the auxiliary pile support has been removed from the one location for permitting leading edges of the sheets in the auxiliary pile to be lowered a distance equal to less than the thickness of the removed auxiliary pile so that the auxiliary pile joins the main pile, said holding means being a plurality of take-up fingers disposed at mutually spaced locations adjacent one another and distributed over the width of the sheets, and including means for individually actuating said take-up fingers.

7. Sheet feeder according to claim 6, wherein said actuating means comprise respective levers connected to said take-up fingers.

8. Sheet feeder having an auxiliary pile supporting device for non-stop operation including an auxiliary pile support of given thickness removable from one location at which an auxiliary pile of sheets is supported thereon above a liftable main sheet pile to another location at which no auxiliary pile sheets are supported thereon, and the sheet feeder also having stops disposed in a sheet feeding path of the auxiliary sheet pile and engageable by a leading region of the auxiliary sheet pile as viewed in sheet feeding direction, the sheet feeder further comprising holding means disposed substantially in a plane extending over the width of the sheets and movable under the leading region of the auxiliary pile, when the auxiliary pile support has been removed from the one location for permitting leading edges of the sheets in the auxiliary pile to be lowered a distance equal to less than the thickness of the removed auxiliary pile so that the auxiliary pile joins the main pile, and mechanically operating means for automatically driving said holding means under the auxiliary pile when the main pile is lowered or converted from main pile operation to auxiliary pile operation, and for automatically withdrawing said holding means therefrom after the main and auxiliary piles have been joined.

* * * * *